United States Patent [19]

Payne

[11] 4,414,717

[45] Nov. 15, 1983

[54] CLOSURE CLIP FOR SNACK FOOD BAGS AND THE LIKE

[76] Inventor: David W. Payne, 7801 Juniper, Prairie Village, Kans. 66208

[21] Appl. No.: 292,233

[22] Filed: Aug. 12, 1981

[51] Int. Cl.[3] ..... B65D 77/10; B65D 33/16

[52] U.S. Cl. ..... 24/30.5 R; 383/91

[58] Field of Search ..... 24/30.5 R, 30.5 S, 30.5 T, 24/30.5 L, 138 R, 32, 35, 67.9, 71.3; 229/62, 65

[56] References Cited

U.S. PATENT DOCUMENTS

| | | | |
|---|---|---|---|
| 183,812 | 10/1876 | Mayo | 24/138 R |
| 662,955 | 12/1900 | McClelland | 24/71.3 |
| 3,066,846 | 12/1962 | Domigan | 24/30.5 R X |
| 3,939,533 | 2/1976 | Benepe | 24/30.5 R |

FOREIGN PATENT DOCUMENTS

| | | | |
|---|---|---|---|
| 361546 | 5/1962 | Switzerland | 24/71.3 |

*Primary Examiner*—Mickey Yu

*Attorney, Agent, or Firm*—Schmidt, Johnson, Hovey & Williams

[57] ABSTRACT

A simple and efficient clip structure and method for fastening snack food bags closed is provided which allows an opened bag to be tightly reclosed. The closure clip is preferably integral and has three elongated, side-by-side laterally spaced apart bag-engaging members (a pair of adjacent long members and a single, outer short member). In use, the flattened upper end of a bag is inserted between the long members, and the clip is rotated axially to form a coil; at this point, the clip is partially withdrawn from the coil until the short member is clear of the bag, whereupon the clip is pushed back towards its original position, but with the short member located outside of the coil for locking the bag against uncoiling. Snack foods or the like can thus be stored in a previously opened bag secured by the closure clip without the food losing its freshness, palatability or nutritional value.

21 Claims, 9 Drawing Figures

CLOSURE CLIP FOR SNACK FOOD BAGS AND THE LIKE

BACKGROUND OF THE INVENTION

1. Field of the Invention

This invention relates to a clip structure and corresponding method for fastening closed previously opened snack food bags and the like. More particularly, it is concerned with a closure clip having at least three elongated, juxtaposed, spaced apart members interconnected at a common end and designed for use in a simple operation to wrap the opened end of a snack food bag or the like into a tight, secured coil that will not unravel during storage.

2. Description of the Prior Art

Snack foods purchased from retail stores are typically sealed in airtight bags to preserve the food in a fresh condition. Once the bag is opened, however, the bag cannot be resealed by merely rolling up the open end of the bag, since the bag will not remain in a coiled form without an appropriate fastener. It is not entirely practical to close a snack food bag with a conventional wire tie fastener, since the stiff construction of typical snack food bags make it difficult to gather the opened end of the bag into a narrow funiculus-like closure that is nearly airtight. Moreover, wire tires become brittle and break after repeated flexing. In any event, the use of a standard wire tie to fasten close a snack food bag will often damage the fragile contents of the bag, is unsightly, and results in the bag being formed in a shape difficult to store. Without an airtight or nearly airtight seal, the contents of a bag will become soggy, stale and unpleasing to the palate and will often lose some of its nutritional value.

A closure attachment for the depending spout of a flexible hopper bag is disclosed in U.S. Pat. No. 3,939,533. The closure attachment, however, is unsuitable for the closing of a snack food bag or the like because, among other reasons, the three elongated members of the closure attachment are of equal or nearly equal length. A number of clips have been proposed in the past for purposes other than sealing closed a bag. None of these clips, however, are suitable for the closing of a snack food bag or the like. Patents illustrating these prior clips include U.S. Pat. Nos. 51,186; 416,588; 2,590,166; 2,927,359; 3,568,687; D-144,079; D-159,576; D-194,785; D-228,520; and D-245,748.

SUMMARY OF THE INVENTION

The problem of closing a bag in a manner that will preserve the freshness of the contents of the bag is in large part solved by the closure clip in accordance with the present invention. That is to say, the closure clip hereof is of simple yet sturdy construction and provides a means for quickly, easily and tightly closing a snack food bag.

A closure clip in accordance with the present invention broadly includes at least three elongated juxtaposed, spaced apart members interconnected at a common end. In preferred forms, the members of the clip are three in number and include one short member and two adjacent long members of equal length, the short member being approximately 40% to 70% of the length of the long members; moreover, the ratio of the length of the longest member to the width of the clip at its widest point is preferably not less than about 3 to 1.

The method of fastening a bag closed in accordance with the invention broadly includes the steps of providing a clip in accordance with the invention, inserting a flattened portion of the bag between a pair of adjacent members of the clip, rotating the clip about its longitudinal axis so as to form a coil from th flattened portion of the bag, withdrawing the clip from the coil far enough to expose the free end of the short member of the clip, and shifting the clip back toward the coil while the member whose free end was exposed slips onto and along the outside of the coil and the remaining two members of the clip fit into the interior of the coil.

DESCRIPTION OF THE PREFERRED EMBODIMENT

Figure 1:
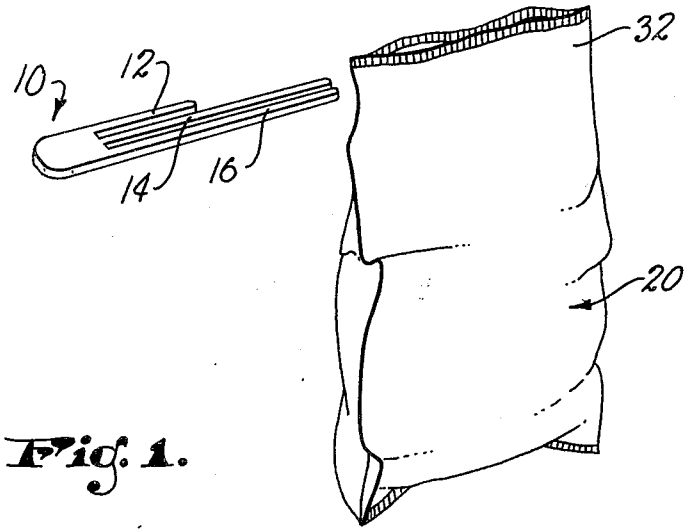
FIG. 1 is a perspective view of the closure clip hereof, and a snack food bag.

Referring now to the drawing, a closure clip 10 in accordance with the invention broadly includes three elongated, juxtaposed, spaced apart members 12, 14, 16 and a means or body 18 interconnecting the members 12, 14, 16 adjacent a common end thereof.

In more detail, the closure clip 10 is of integral construction and is preferably formed of a sturdy synthetic resin material. The clip 10 includes a short member 12 and two adjacent long members 14,16 of equal length. The short member 12 is preferably from about 40% to 70% the length of the longer members 14,16. The three members lie in substantially a single plane and are interconnected at one end by the body 18. The ends of the members 12, 14, 16 remote from the body 18 are free and not interconnected. The length of members 14,16 is advantageously equal to or slightly shorter than the width of a bag 20 to be closed.

Figure 7:
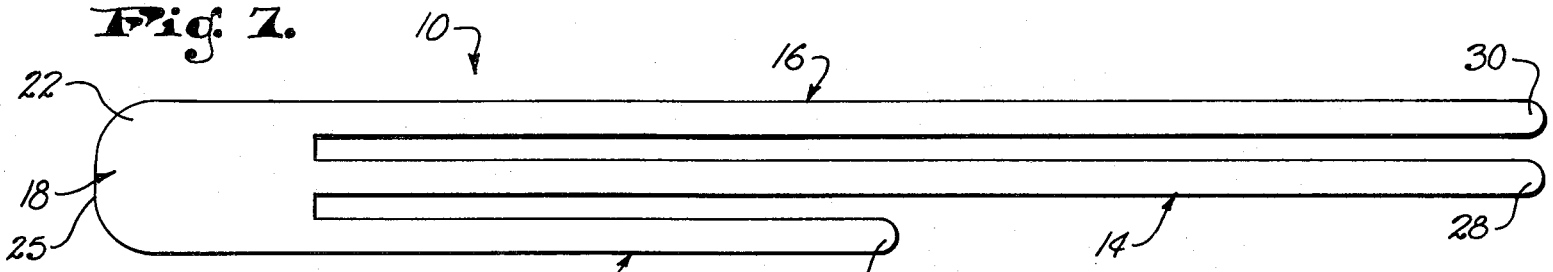
FIG. 7 is a plan view of the clip of FIG. 6.
Figure 8:
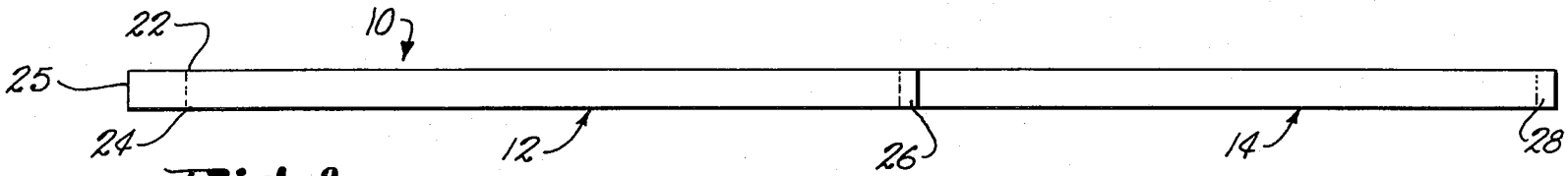
FIG. 8 is a side elevational view of the clip, with the shorter member in the foreground.
Figure 6:
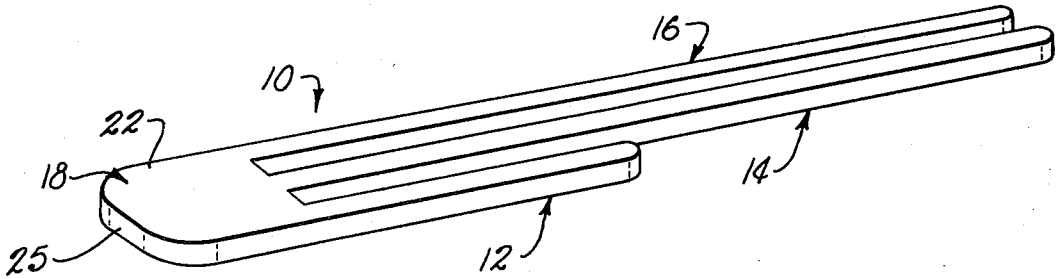
FIG. 6 is an enlarged perspective view of the preferred closure clip.

The detailed structure of the closure clip can best be understood through a study of FIGS. 6–8. The body 18 of the clip 10 has two opposed, spaced apart, generally planar faces 22,24 and a smooth, continuous arcuate sidewall 25.

The members 12, 14, 16 extend outwardly from the body 18, are integral therewith, and are laterally spaced apart and have a relative length and disposition as described above. The generally rectangularly columnar shape of the members 12, 14, 16 can best be seen in FIG. 6. Further, (FIG. 7) the free ends 26, 28, 30 of the members 12, 14, 16 are rounded to present generally arcuate faces.

Figure 2:
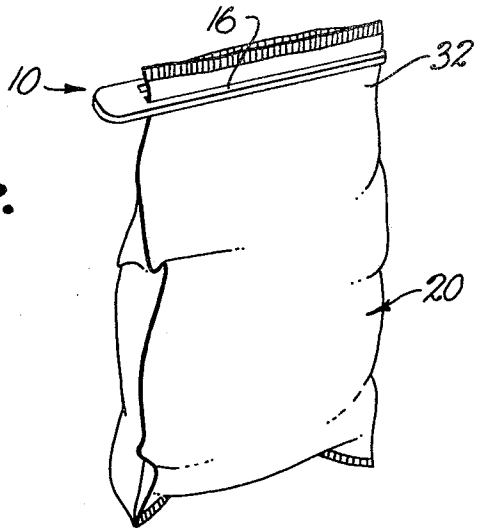
FIG. 2 is a perspective view of the closure clip and bag with a flattened marginal portion of the bag inserted between a pair of adjacent members of the clip.
Figure 3:
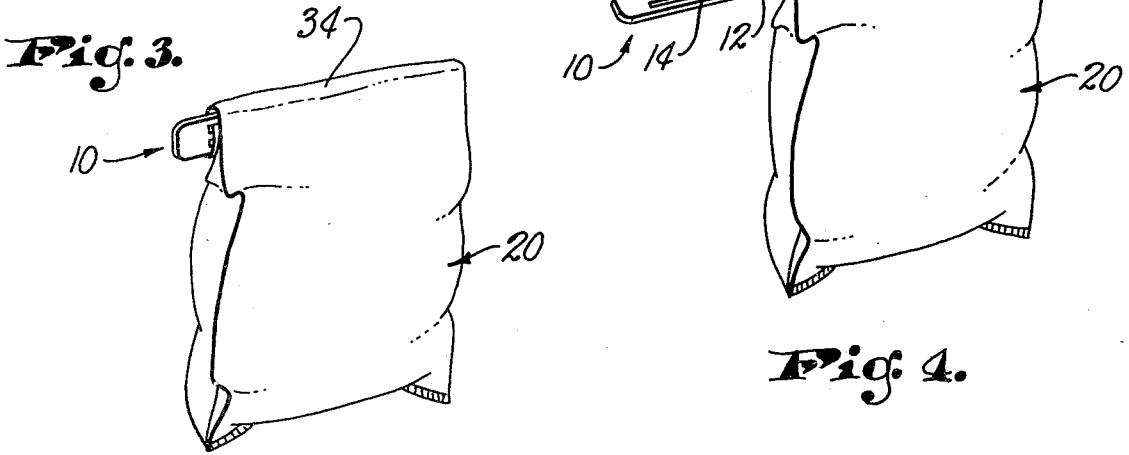
FIG. 3 is a perspective view of the closure clip and the bag, with a section of the bag coiled around the closure clip.
Figure 4:
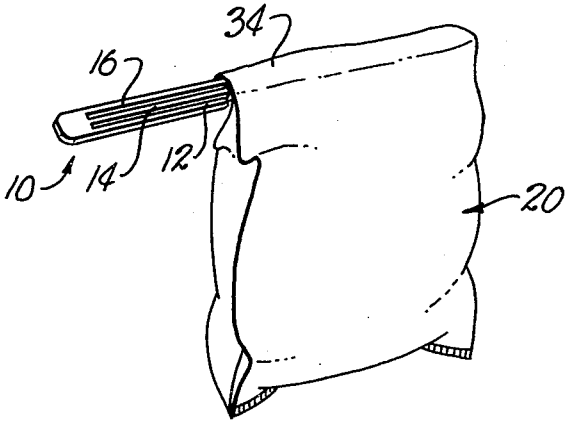
FIG. 4 is a perspective view of the closure clip and the bag, with the closure clip partially removed from the coil to expose the free end of one elongated member of the clip.
Figure 5:
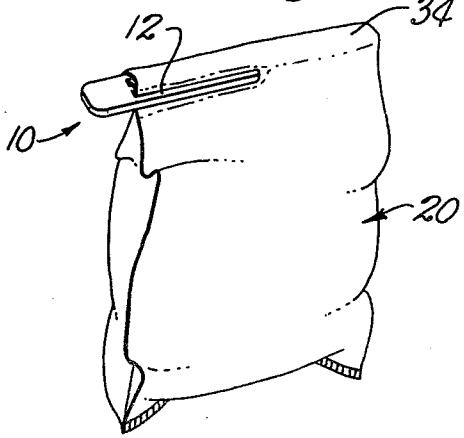
FIG. 5 is a perspective view of the closure clip and the bag, with the bag securely fastened closed by the closure clip.
Figure 9:
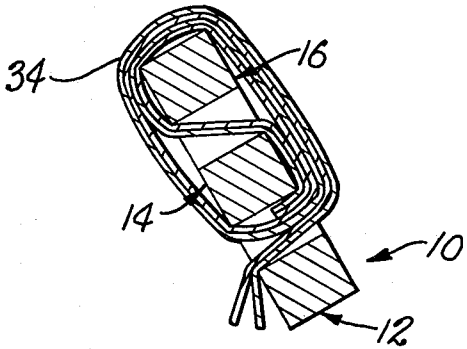
FIG. 9 is an enlarged, fragmentary, transverse sectional view of the clip affixed to a bag and closing the latter.

FIGS. 1–5 demonstrate the use of the closure clip 10 in fastening closed snack food bag 20. In FIG. 1 the closure clip 10 is aligned to receive a flattened marginal portion 32 of the bag 20 between the two longest members 14,16 thereof. FIG. 2 depicts the flattened portion 32 of the bag received between the two longer members 14,16 of the clip 10. In FIG. 3 the portion 32 of the bag 20 is shown coiled about the members 12, 14, 16 of the closure clip 10, the clip 10 having been axially rotated to form a coil 34. FIG. 4 is similar to FIG. 3, but illustrates clip 10 partially retracted from the coil 34, so as to expose the leading edge 26 of the shorter member 12. In FIG. 5 the closure clip 10 is shown shifted back within the coil 34, but with the shorter member 12 located exteriorly of the coil 34 and the members 14,16 located within the coil 34. This operation may sometimes involve axial rotation of clip 10 in its partially withdrawn (FIG. 4) condition until the member 12 is oriented for passage outside of the coil 34 and is free from interference with the remainder of bag 20. As can best be seen in FIG. 9, the operation described above securely fastens closed the bag 20, the exterior member 12 serving to lock the coil 34 against unintended unravelling. When it is desired to reopen the bag 20, it is only necessary to withdraw clip 10 entirely from coil 34, thereby permitting access to the bag's contents.

Those skilled in the art will appreciate that this simple means for fastening closed a snack food bag will allow for the storage of the bag's contents in a manner which retains the freshness, palatability and nutritional value of the contents. They will also appreciate that the closure clip of the present invention is not limited to use with bags or sacks only, but instead may find significant utility in connection, for example, with tubular, viscous product dispensers, such as tooth paste "tubes," and other containers.

I claim:

1. A clip for fastening closed a bag or the like comprising:

a unitary, multi-slotted body having at least three elongated, juxtaposed, at least generally equally spaced apart members including at least one long member and a short member which is longitudinally fixed in position relative to the other members, said short member being approximately 40% to 70% of the length of said long member; and means integrally interconnecting said members adjacent a common end thereof, the ends of said members remote from said interconnecting means being free, the ratio of the length of said long member to the width of said clip at its widest point being not less than about 3 to 1, said members cooperating to define a pair of elongated, bag-receiving slots therebetween, each of which has substantially parallel, non-diverging lateral extremities throughout the length thereof for properly confining respective portions of a bag when attached thereto.

2. A clip as in claim 1, said members lying in substantially a single plane.

3. A clip as in claim 1, there being three members, two of which have substantially the same length and are adjacent one another.

4. A clip as in claim 1, said lateral extremities of the slots being continuously smooth and uncorrugated.

5. A clip for fastening closed a bag or the like comprising:

a unitary, multi-slotted body having at least three elongated, juxtaposed, substantially rectilinear, at least generally equally spaced apart members including at least one long member and a short member, said short member being approximately 40% to 70% of the length of said long member and being in fixed longitudinal relation thereto; and means integrally interconnecting said members adjacent a common end thereof, the ends of said members remote from said interconnecting means being free, said members cooperating to define a pair of elongated, bag-receiving slots therebetween, each of which has substantially parallel, non-diverging lateral extremities throughout the length thereof for properly confining respective portions of a bag when attached thereto.

6. A clip as in claim 5, said members lying in substantially a single plane.

7. A clip as in claim 5, the ratio of the length of said long member to the width of the clip at its widest point being not less than about 3 to 1.

8. A clip as in claim 5, there being three members, two of which have substantially the same length and are adjacent one another.

9. A clip as in claim 5, said lateral extremities of the slots being continuously smooth and uncorrugated.

10. In combination with an open-ended bag or the like having two generally polygonal panels joined together at their lateral edges, a clip resealing the bag in closed condition and comprising:

a unitary, multi-slotted body having at least three elongated, relatively stiff, juxtaposed, at least generally equally spaced apart legs integrally interconnected adjacent a common end thereof and mutually disconnected adjacent the opposite end thereof, one of said legs being shorter than the others and all three of said legs being fixed against longitudinal movement relative to one another, said bag having a section thereof formed in a coil extending across the bag generally parallel to the open end thereof, with the two longer legs of the clip and a retained stretch of the bag wrapped within and circumscribed by said coil, and with the shorter leg of the clip located exteriorly of said coil and against the bag to prevent unwrapping thereof.

11. The combination as in claim 10, said shorter leg being approximately 40% to 70% of the length of at least one of the longer legs.

12. The combination as in claim 10, the length of said longer legs generally matching the length of said coil.

13. The combination as in claim 10, said legs each being provided with longitudinal, bag-engaging marginal edges formed by intersecting surfaces thereof for assisting in frictionally retaining the clip in place on the bag as portions of the bag interiorly of the coil bend across said edges.

14. The combination as in claim 10, said legs defining a pair of elongated, parallel slots therebetween having non-diverging lateral extremities.

15. The combination as in claim 14, said lateral extremities of the slots being continuously smooth and uncorrugated.

16. The combination as in claim 15, said lateral extremities of the slots being transversely flat.

17. A method of resealing the opened end of a bag or the like to prevent the escape of contents therefrom and the substantial entry of ambient air thereinto comprising the steps of:

providing a clip having at least three elongated, generally side-by-side, laterally spaced legs which are mutually disconnected across one end of the clip, one of which legs is shorter than the others;

pressing together flat superimposed panel portions of the bag in the area to be resealed whereby to reclose the bag; and attaching the clip to the bag across the latter and generally parallel to said end thereof in such a manner that a flattened stretch of the superimposed portions is retained between the two longer legs of the clip, the two longer legs and the retained stretch are wrapped snuggly inside a coiled up section of the panel portions, and the third, shorter leg of the clip is disposed against the outside of the coiled up section holding the same against unwrapping from around the longer legs, said attaching step including initially slipping the clip endwise onto the bag to insert the retained stretch between the two long legs, then rotating the clip about a longitudinal axis of the legs to momentarily coil up the panel portions about all three of the legs, then partially withdrawing the clip from the coiled up section until the free end of the shorter leg is exposed, and then shifting the clip endwise back toward the bag to slip the shorter leg onto the outside of the coiled up section while the longer legs remain wrapped inside the coiled up section.

18. A bag resealing method as claimed in claim 17, wherein said providing step includes selecting a clip in which the length of said longer legs generally matches the width of the bag as measured in the direction the clip normally extends across the bag when attached thereto.

19. A method of resealing the opened end of a bag or the like to prevent the escape of contents therefrom and the substantial entry of ambient air thereinto comprising the steps of:

providing a clip having a unitary, multi-slotted body that presents at least three relatively stiff, elongated, generally side-by-side, at least generally equally laterally spaced apart legs which are mutually disconnected across one end of the clip, one of which legs is shorter than the others and is in longitudinally fixed relation thereto;

pressing together flat superimposed panel portions of the bag in the area to be resealed whereby to reclose the bag; and attaching the clip to the bag across the latter and generally parallel to said end thereof in such a manner that a flattened stretch of the superimposed portions is retained between the two longer legs of the clip, the two longer legs and the retained stretch are wrapped snuggly inside a coiled up section of the panel portions, and the third, shorter leg of the clip is disposed against the outside of the coiled up section holding the same against unwrapping from around the longer legs.

20. A bag resealing method as claimed in claim 19, wherein said attaching step includes initially slipping the clip endwise onto the bag to insert the retained stretch between the two long legs, then rotating the clip about a longitudinal axis of the legs momentarily coil up the panel portions about all three of the legs, then partially withdrawing the clip from the coiled up section until the free end of the shorter leg is exposed, and then shifting the clip endwise back toward the bag to slip the shorter leg onto the outside of the coiled up section while the longer legs remain wrapped inside the coiled up section.

21. A bag resealing method as claimed in claim 20, wherein said providing step includes selecting a clip in which the length of said longer legs generally matches the width of the bag as measured in the direction the clip normally extends across the bag when attached thereto.

* * * * *